US007562954B2

(12) United States Patent
Iwao

(10) Patent No.: US 7,562,954 B2
(45) Date of Patent: Jul. 21, 2009

(54) INKJET PRINTER

(75) Inventor: Naoto Iwao, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 271 days.

(21) Appl. No.: 11/615,696

(22) Filed: Dec. 22, 2006

(65) Prior Publication Data

US 2007/0146402 A1 Jun. 28, 2007

(30) Foreign Application Priority Data

Dec. 27, 2005 (JP) ..... 2005-374524

(51) Int. Cl.
*B41J 29/38* (2006.01)

(52) U.S. Cl. ..... 347/11

(58) Field of Classification Search ..... 347/11
See application file for complete search history.

(56) References Cited

U.S. PATENT DOCUMENTS 6,059,393 A 5/2000 Takahashi
6,106,092 A 8/2000 Norigoe et al.
2006/0187263 A1 8/2006 Iwao et al.

FOREIGN PATENT DOCUMENTS

EP 0968822 A2 1/2000
EP 1695827 A1 8/2006
JP H09-66603 A 3/1997

OTHER PUBLICATIONS

European Patent Office, European Search Report for Application No. EP06026626, dated May 15, 2008.

*Primary Examiner*—Julian D Huffman
(74) *Attorney, Agent, or Firm*—Baker Botts, LLP.

(57) ABSTRACT

An aspect of the invention provides an inkjet printer including: an inkjet head and a controller. The inkjet head moves relative to a recording medium to perform printing. The inkjet head includes, a flow path unit including plural pressure chambers respectively communicating with plural ink ejection ports that ejects ink droplets toward the recording medium, and a piezoelectric actuator configured to take a first state and a second state. The controller supplies a drive pulse signal to the piezoelectric actuator in order to repeat an operation in which the piezoelectric actuator transits from the first state to the second state and returns to the first state, for enabling the corresponding ink ejection port to eject a plurality of ink droplets. The controller supplies the drive pulse signal so that timings of the transition and the return satisfy some relationships.

8 Claims, 9 Drawing Sheets

Fig. 8

| B(AL) \ C(AL) | 0.108 | 0.162 | ··· | 0.703 | 0.757 | 0.811 | 0.865 | 0.919 | 0.973 | 1.027 | 1.081 | 1.135 | 1.189 | 1.243 |
|---|---|---|---|---|---|---|---|---|---|---|---|---|---|---|
| 0.324 | 1.43 | 1.49 | ··· | 2.03 | 2.08 | 2.14 | 2.19 | 2.24 | 2.30 | 2.35 | 2.41 | 2.46 | 2.51 | 2.57 |
| 0.432 | 1.54 | 1.59 | ··· | 2.14 | 2.19 | 2.24 | 2.30 | 2.35 | 2.41 | 2.46 | 2.51 | 2.57 | 2.62 | 2.68 |
| ⋮ | ⋮ | ⋮ | | ⋮ | ⋮ | ⋮ | ⋮ | ⋮ | ⋮ | ⋮ | ⋮ | ⋮ | ⋮ | ⋮ |
| 2.378 | 3.49 | 3.54 | ··· | 4.08 | 4.14 | 4.19 | 4.24 | 4.30 | 4.35 | 4.41 | 4.46 | 4.51 | 4.57 | 4.62 |
| 2.486 | 3.59 | 3.65 | ··· | 4.19 | 4.24 | 4.30 | 4.35 | 4.41 | 4.46 | 4.51 | 4.57 | 4.62 | 4.68 | 4.73 |
| 2.595 | 3.70 | 3.76 | ··· | 4.30 | 4.35 | 4.41 | 4.46 | 4.51 | 4.57 | 4.62 | 4.68 | 4.73 | 4.78 | 4.84 |
| 2.703 | 3.81 | 3.86 | ··· | 4.41 | 4.46 | 4.51 | 4.57 | 4.62 | 4.68 | 4.73 | 4.78 | 4.84 | 4.89 | 4.95 |
| 2.811 | 3.92 | 3.97 | ··· | 4.51 | 4.57 | 4.62 | 4.68 | 4.73 | 4.78 | 4.84 | 4.89 | 4.95 | 5.00 | 5.05 |
| 2.919 | 4.03 | 4.08 | ··· | 4.62 | 4.68 | 4.73 | 4.78 | 4.84 | 4.89 | 4.95 | 5.00 | 5.05 | 5.11 | 5.16 |
| 3.027 | 4.14 | 4.19 | ··· | 4.73 | 4.78 | 4.84 | 4.89 | 4.95 | 5.00 | 5.05 | 5.11 | 5.16 | 5.22 | 5.27 |
| 3.135 | 4.24 | 4.30 | ··· | 4.84 | 4.89 | 4.95 | 5.00 | 5.05 | 5.11 | 5.16 | 5.22 | 5.27 | 5.32 | 5.38 |
| 3.243 | 4.35 | 4.41 | ··· | 4.95 | 5.00 | 5.05 | 5.11 | 5.16 | 5.22 | 5.27 | 5.32 | 5.38 | 5.43 | 5.49 |
| 3.351 | 4.46 | 4.51 | ··· | 5.05 | 5.11 | 5.16 | 5.22 | 5.27 | 5.32 | 5.38 | 5.43 | 5.49 | 5.54 | 5.59 |

Fig. 9

| B/A \ C/A | 0.108 | 0.162 | ··· | 0.703 | 0.757 | 0.811 | 0.865 | 0.919 | 0.973 | 1.027 | 1.081 | 1.135 | 1.189 | 1.243 |
|---|---|---|---|---|---|---|---|---|---|---|---|---|---|---|
| 0.324 | 1.43 | 1.49 | ··· | 2.03 | 2.08 | 2.14 | 2.19 | 2.24 | 2.30 | 2.35 | 2.41 | 2.46 | 2.51 | 2.57 |
| 0.432 | 1.54 | 1.59 | ··· | 2.14 | 2.19 | 2.24 | 2.30 | 2.35 | 2.41 | 2.46 | 2.51 | 2.57 | 2.62 | 2.68 |
| ⋮ | ⋮ | ⋮ | | ⋮ | ⋮ | ⋮ | ⋮ | ⋮ | ⋮ | ⋮ | ⋮ | ⋮ | ⋮ | ⋮ |
| 2.378 | 3.49 | 3.54 | ··· | 4.08 | 4.14 | 4.19 | 4.24 | 4.30 | 4.35 | 4.41 | 4.46 | 4.51 | 4.57 | 4.62 |
| 2.486 | 3.59 | 3.65 | ··· | 4.19 | 4.24 | 4.30 | 4.35 | 4.41 | 4.46 | 4.51 | 4.57 | 4.62 | 4.68 | 4.73 |
| 2.595 | 3.70 | 3.76 | ··· | 4.30 | 4.35 | 4.41 | 4.46 | 4.51 | 4.57 | 4.62 | 4.68 | 4.73 | 4.78 | 4.84 |
| 2.703 | 3.81 | 3.86 | ··· | 4.41 | 4.46 | 4.51 | 4.57 | 4.62 | 4.68 | 4.73 | 4.78 | 4.84 | 4.89 | 4.95 |
| 2.811 | 3.92 | 3.97 | ··· | 4.51 | 4.57 | 4.62 | 4.68 | 4.73 | 4.78 | 4.84 | 4.89 | 4.95 | 5.00 | 5.05 |
| 2.919 | 4.03 | 4.08 | ··· | 4.62 | 4.68 | 4.73 | 4.78 | 4.84 | 4.89 | 4.95 | 5.00 | 5.05 | 5.11 | 5.16 |
| 3.027 | 4.14 | 4.19 | ··· | 4.73 | 4.78 | 4.84 | 4.89 | 4.95 | 5.00 | 5.05 | 5.11 | 5.16 | 5.22 | 5.27 |
| 3.135 | 4.24 | 4.30 | ··· | 4.84 | 4.89 | 4.95 | 5.00 | 5.05 | 5.11 | 5.16 | 5.22 | 5.27 | 5.32 | 5.38 |
| 3.243 | 4.35 | 4.41 | ··· | 4.95 | 5.00 | 5.05 | 5.11 | 5.16 | 5.22 | 5.27 | 5.32 | 5.38 | 5.43 | 5.49 |
| 3.351 | 4.46 | 4.51 | ··· | 5.05 | 5.11 | 5.16 | 5.22 | 5.27 | 5.32 | 5.38 | 5.43 | 5.49 | 5.54 | 5.59 |

INKJET PRINTER

CROSS-REFERENCE TO RELATED APPLICATION

This application claims priority from Japanese Patent Application No. 2005-374524, filed on Dec. 27, 2005, the entire subject matter of which is incorporated herein by reference.

TECHNICAL FIELD

Aspects of the present invention relate to an inkjet printer in which an ink is ejected from ink ejection ports to perform printing on a recording medium.

BACKGROUND

There is an inkjet printer in which an ink is ejected from nozzles (ink ejection ports), and plural ink droplets are successively ejected from one nozzle in order to form one pixel. JP-A-9-66603 discloses an ink ejection device (inkjet printer), in which two ink droplets are successively ejected and the later ejected ink droplet is merged with the initially ejected ink droplet before the ink droplets reach a sheet face. The merged ink droplet then reaches the sheet face. In order to enable the two ink droplets to merge before reaching the sheet face, two pulse signals having a pulse width equal to a propagate time period (AL) and different voltages are applied at a time interval of 2.5AL. Alternatively, two pulse signals which have pulse widths of 0.5AL and AL, respectively, having the same voltage are applied at a time interval of 2.5AL. Here, the propagate time period AL represents a time required for a pressure wave generated in the ink filling the ink channel to the other end of the ink channel in a lengthwise direction of the ink channel.

SUMMARY

In the ink ejection device disclosed in JP-A-9-66603, when the propagate time period AL is varied for ink channels of an inkjet head, the ink droplet ejection characteristics may be varied for plural nozzles, and the printing quality may be lowered.

Aspects of the invention provide an inkjet printer, in which the ink droplet ejection characteristics are maintained, even when printing is performed while plural ink droplets are successively ejected from one nozzle to form one pixel.

An aspect of the invention provides an inkjet printer including an inkjet head and a controller. The inkjet head moves relative to a recording medium to perform printing. The inkjet head includes, a flow path unit including a plurality pressure chambers respectively communicating with a plurality of ink ejection ports that ejects ink droplets toward the recording medium, and a piezoelectric actuator configured to take a first state where a volume of the pressure chamber is to be V1, and a second state where the volume of the pressure chamber is to be V2 larger than V1. The controller supplies a drive pulse signal to the piezoelectric actuator in order to repeat an operation in which the piezoelectric actuator transits from the first state to the second state and returns to the first state, during a printing period required for the recording medium and the inkjet head to relatively move by a unit distance corresponding to a resolution of the printing, for enabling the corresponding ink ejection port to eject a plurality of ink droplets at an ejecting speed. The controller supplies the drive pulse signal so that the following relationships are satisfied, $4.5AL \leqq A+B+C \leqq 5.4AL$, $2.60AL \leqq B \leqq 3.35AL$, and $0.81AL \leqq C \leqq 1.14AL$. Here, AL represents a time period from a time when a transition from the first state to the second state is started, to a time when a return from the second state to the first state is started, causing the ejecting speed to be maximum; A represents a time period from a time when a first transition from the first state to the second state is started, to a time when a first return from the second state to the first state is started, during the printing period; B represents a time period from the time when the first return from the second state to the first state is started, to a time when a second transition from the first state to the second state is started, during the printing period; C represents a time period form the time when the second transition from the first state to the second state is started, to a time when a second return from the second state to the first state is started, during the printing period.

BRIEF DESCRIPTION OF THE DRAWINGS

FIG. 4 is a section view taken along the line IV-IV of FIG. 3;

FIG. 9 is a table showing results which were obtained by the method shown in FIGS. 7A and 7B, in the different format from that of FIG. 8.

DETAILED DESCRIPTION

Now, description will be given below of an aspect according to the invention with reference to the accompanying drawings.

Figure 1:
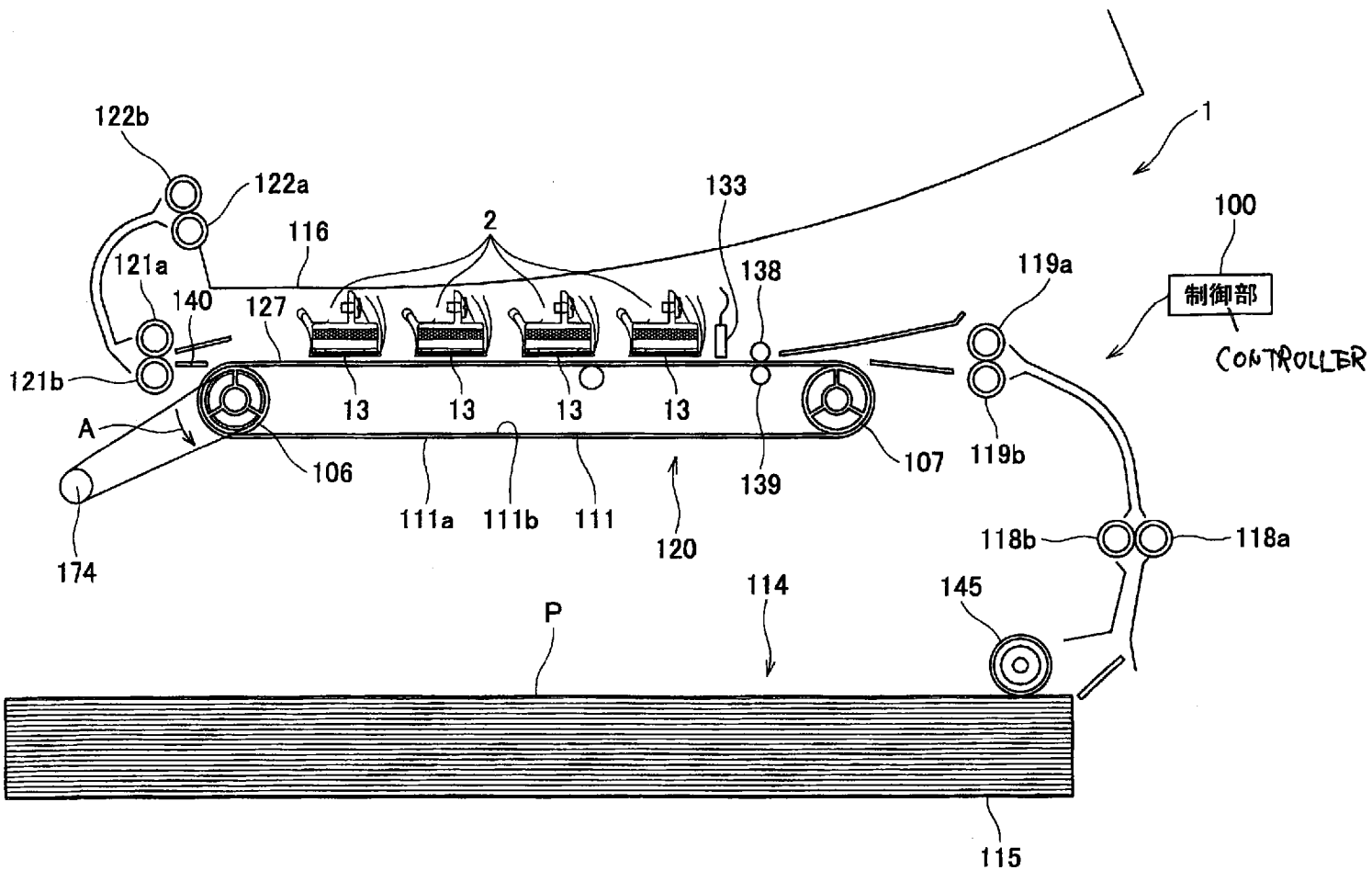
FIG. 1 is a diagram showing the configuration of an inkjet printer according to an aspect of the invention.

First, an inkjet head according to an aspect of the invention will be described. FIG. 1 shows a printer 1 including inkjet heads 2. The printer 1 shown in FIG. 1 is a line-head type color inkjet printer having four fixed inkjet heads 2, which are rectangular in a plan view in the direction perpendicular to the sheet of FIG. 1. In the printer 1, a sheet supplying section 114 is disposed at a lower side and a sheet discharge tray 116 is disposed at the upper side. Further, a transport unit 120 is disposed therebetween. The printer 1 further includes a controller 100 that controls operations of the components.

The sheet supplying section 114 includes: a sheet housing portion 115 that can house plural stacked rectangular printing sheets (recording media) P; and a sheet supply roller 145 that feeds out one by one the uppermost printing sheet P in the sheet housing portion 115. The printing sheets P are housed in the sheet housing portion 115 in such a manner that the printing sheets are supplied in a direction parallel to their long sides. Two pairs of feed rollers 118*a*, 118*b* and 119*a*, 119*b* are placed along a transport path between the sheet housing portion 115 and the transport unit 120. The printing sheet P supplied from the sheet supplying section 114 is fed toward the upper side in FIG. 1 by the feed rollers 118*a*, 118*b* while one short side thereof being the leading end. Thereafter, the printing sheet is transported toward the transport unit 120 by the feed rollers 119*a*, 119*b*.

The transport unit 120 includes: an endless transport belt 111; and two belt rollers 106, 107 around which the transport belt 111 is wound. The transport belt 111 is adjusted so as to have a length at which a predetermined tension is maintained in the transport belt 111 wound around the two belt rollers 106, 107. Since the transport belt 111 is wound around the two belt rollers 106, 107, two planes that are parallel to each other and include common tangential lines of the belt rollers 106, 107, respectively, are formed on the transport belt 111. One of the planes opposed to the inkjet heads 2 functions as a transport face 127 for the printing sheet P. The printing sheet P fed out from the sheet supplying section 114 is transported on the transport face 127 formed by the transport belt 111, while printing is being performed on the upper face (printing face) by the inkjet heads 2, and then reaches the sheet discharge tray 116. On the sheet discharge tray 116, plural printing sheets P on which printing has been performed are placed in a stacked manner.

Each of the four inkjet heads 2 has a head body 13 at a lower end thereof. The head body 13 has a configuration in which, as described later, four piezoelectric actuators 21 that can apply a pressure to the ink in desired pressure chambers 10 are bonded by an adhesive agent to a flow path unit 4 in which many individual ink flow paths 32 including the pressure chambers 10 communicating with nozzles 8 are formed (see FIGS. 2 and 4). An FPC (Flexible Printed Circuit, not shown) through which a print signal is supplied is bonded to each of the piezoelectric actuators 21.

Figure 3:
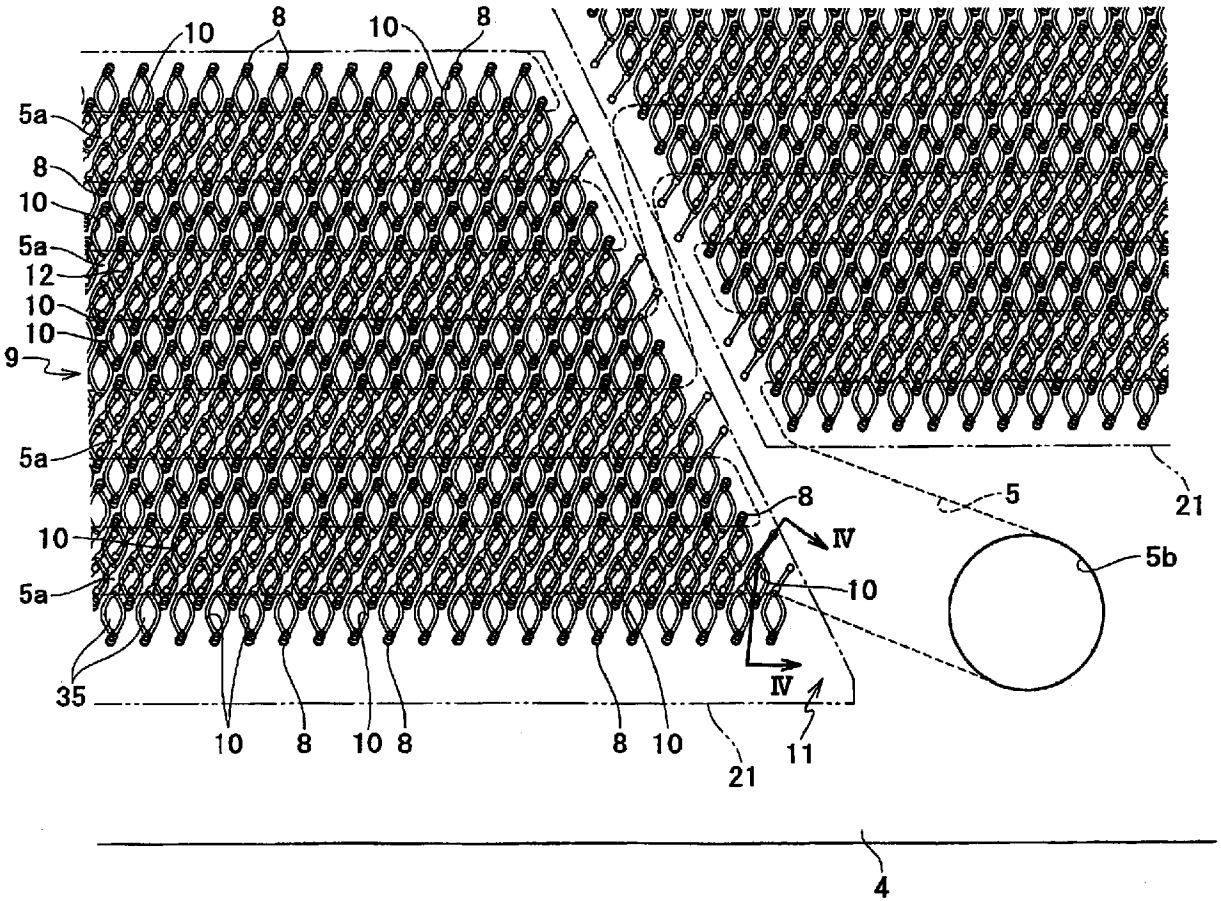
FIG. 3 is a partial enlarged view of FIG. 2.

In a plan view, the head body 13 has an elongated parallelepiped shape, which extends in the direction perpendicular to the sheet of FIG. 1. The four head bodies 13 are closely arranged horizontally as shown in FIG. 1. Each head bodies has plural nozzles 8 having a minute diameter on its lower face (ink, ejection face) as shown in FIG. 3. The color of the ink ejected from the nozzles 8 is one of magenta (M), yellow (Y), cyan (C), and black (B). The plural nozzles 8 belonging to one head body 13 eject an ink of the same color. Furthermore, the plural nozzles 8 belonging to the four head bodies 13 eject inks of different colors selected from the four colors of magenta, yellow, cyan, and black.

A small gap is formed between the lower faces of the head bodies 13 and the transport face 127 of the transport belt 111. The printing sheet P is transported from the right side in FIG. 1 toward the left side along a transport path that is defined by the gap. When the printing sheet P passes sequentially under the four head bodies 13, the ink is ejected toward the upper face of the printing sheet P from the nozzles 8 in accordance with image data, whereby a desired color image is formed on the printing sheet P (printing is performed by relatively moving the recording medium with respect to the inkjet head).

The two belt rollers 106, 107 are in contact with the inner peripheral face 111*b* of the transport belt 111. The belt roller 106 which is positioned downstream side of the transport path is coupled with a transport motor 174. The transport motor 174 is rotatingly driven on the basis of the control of the controller 100. The other belt roller 107 is a driven roller rotated by the rotational force given from the transport belt 111 in accordance with the rotation of the belt roller 106.

A nip roller 138 and a nip-receiving roller 139 are placed in the vicinity of the belt roller 107 so as to sandwich the transport belt 111. The nip roller 138 is downward urged by a spring (not shown) so that the printing sheet P supplied to the transport unit 120 is pressed against the transport face 127. The nip roller 138 and the nip-receiving roller 139 nip the printing sheet P together with the transport belt 111. In this aspect, the outer peripheral face of the transport belt 111 is treated with adhesive silicon rubber, so that the printing sheet P is surely adhered to the transport face 127.

A separation plate 140 is disposed on the left side of the transport unit 120 in FIG. 1. The right end of the separation plate 140 enters between the printing sheet P and the transport belt 111, whereby the printing sheet P adhered to the transport face 127 of the transport belt 111 is peeled from the transport face 127.

Two pairs of feed rollers 121*a*, 121*b* and 122*a*, 122*b* are placed between the transport unit 120 and the sheet discharge tray 116. The printing sheet P discharged from the transport unit 120 is fed toward the upper side in FIG. 1 by the feed rollers 121*a*, 121*b* while one short side thereof being the leading end, and then fed to the sheet discharge tray 116 by the feed rollers 122*a*, 122*b*.

In order to detect the leading end of the printing sheet P on the transport path, a sheet face sensor 133 that is an optical sensor including a light-emitting element and a light-receiving element is placed between the nip roller 138 and the inkjet head 2 on the most upstream side.

Figure 2:
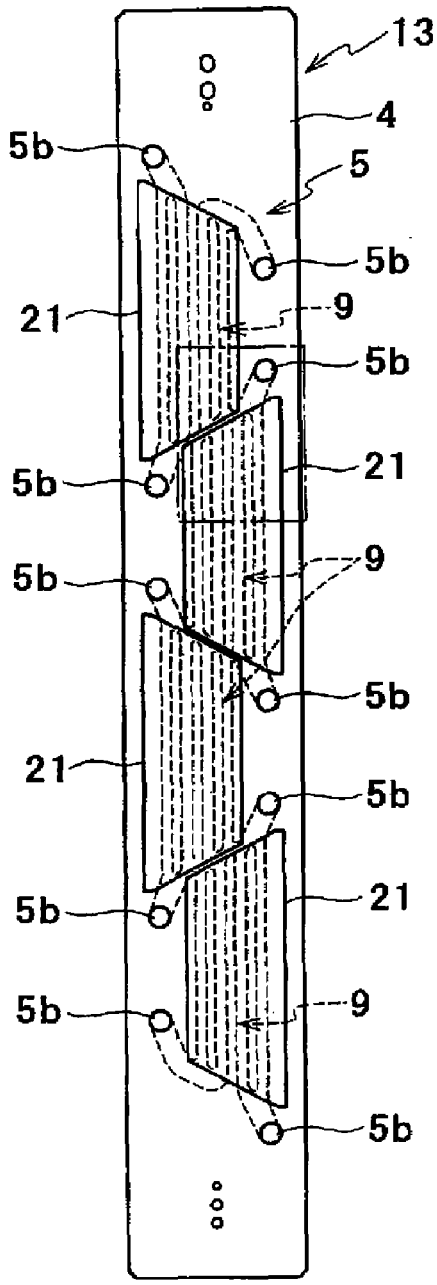
FIG. 2 is a plan view of a head body in FIG. 1.

Next, the head body 13 will be described in detail. FIG. 2 is a plan view of the head body 13 shown in FIG. 1, and FIG. 3 is an enlarged plan view showing a portion enclosed by the one-dot chain line in FIG. 2. As shown in FIGS. 2 and 3, the head body 13 has the flow path unit 4 including the plural pressure chambers 10 constituting four pressure chamber groups 9 and the many nozzles 8 communicating with the pressure chambers 10. The four trapezoidal piezoelectric actuators 21 arranged in two staggered rows are bonded to the upper face of the flow path unit 4. More specifically, the piezoelectric actuators 21 are arranged so that their parallel opposed sides (the upper and lower sides) extend along the longitudinal direction of the flow path unit 4. Oblique sides of adjacent ones of the piezoelectric actuators 21 overlap with each other in the width direction of the flow path unit 4.

The lower face of the flow path unit 4 opposed to the adhesion region of the piezoelectric actuator 21 has ink ejection regions. As shown in FIG. 3, the plural nozzles 8 are regularly arranged in the surface of each ink ejection region. In the upper face of the flow path unit 4, the many pressure chambers 10 are arranged in a matrix pattern. In the upper face of the flow path unit 4, the plural pressure chambers 10 existing in an area opposed to one piezoelectric actuator 21 constitute one pressure chamber group 9. As described later, one individual electrode 35 formed on the piezoelectric actuator 21 is opposed to each pressure chamber 10. Some of the pressure chambers 10 are arranged in the longitudinal direction of the flow path unit 4 to constitute a pressure chamber row. Sixteen pressure chamber rows are formed in parallel. In accordance with the external shape of the piezoelectric actuator 21, the number of pressure chambers 10 included in each row on the short side is reduced.

A manifold flow path 5 that is a common ink chamber, and submanifold flow paths 5*a* that are branch flow paths are formed in the flow path unit 4. Four submanifold flow paths 5*a* that extend in the longitudinal direction of the flow path unit 4 are opposed to one ink ejection region. An ink is supplied to the manifold flow path 5 from an ink supply port 6 formed in the upper face of the flow path unit 4.

Each of the nozzles 8 communicates with the submanifold flow path 5*a* through the pressure chamber 10, which has approximately rhombic shape in a plan view, and an aperture 12. Nozzles 8 included in four nozzle rows that adjacently extend in the longitudinal direction of the flow path unit 4 communicate with the same submanifold flow path 5*a*. In FIGS. 2 and 3, in order to facilitate the understanding of the drawings, the piezoelectric actuators 21 are drawn by two-dot chain lines, and the pressure chambers 10 (the pressure camber groups 9) and apertures 12 that are below the piezoelectric actuators 21 and should be drawn by broken lines are drawn by solid lines.

The plural nozzles 8 formed in the flow path unit 4 are arranged so that projection points that are obtained by projecting all the nozzles 8 onto a virtual line extending in the longitudinal direction of the flow path unit 4 (perpendicular to the sheet transport direction) in a direction perpendicular to the virtual line are aligned at regular intervals corresponding to 600 dpi.

Next, the sectional structure of the head body 13 will be described. FIG. 4 is a section view taken along the line IV-IV of FIG. 3. As shown in FIG. 4, the head body 13 is configured by bonding the flow path unit 4 to the piezoelectric actuator 21. The flow path unit 4 has a stacked structure in which a cavity plate 22, a base plate 23, an aperture plate 24, a supply plate 25, manifold plates 26, 27, 28, a cover plate 29, and a nozzle plate 30 are stacked together in this order form the top. In the flow path unit 4, ink flow paths extending to the nozzles 8 from which an externally supplied ink is to be ejected as droplets are formed. The ink flow paths include: the manifold flow paths 5 and submanifold flow paths 5*a* that temporarily store the ink; the plural individual ink flow paths 32 extending from the outlets of the submanifold flow paths 5*a* to the nozzles 8; and the like. Recesses and holes that function as components of the ink flow paths are formed in the plates 22 to 30.

The cavity plate 22 is a metal plate in which plural substantially rhombic holes functioning as the pressure chambers 10 are formed. The base plate 23 is a metal plate in which plural communication holes through which the pressure chambers 10 communicate with the corresponding apertures 12, and plural communication holes through which the pressure chambers 10 communicate with the corresponding nozzles 8 are formed. The aperture plate 24 is a metal plate in which holes functioning as the apertures 12, and communication holes through which the pressure chambers 10 communicate with the corresponding nozzles 8 are formed in a large number. The supply plate 25 is a metal plate in which plural communication holes through which the apertures 12 communicate with the submanifold flow paths 5*b*, and plural communication holes through which the pressure chambers 10 communicate with the corresponding nozzles 8 are formed. The manifold plates 26, 27, 28 are metal plates in which holes functioning as the submanifold flow paths 5*a*, and communication holes through which the pressure chambers 10 communicate with the corresponding nozzles 8 are formed in a large number. The cover plate 29 is a metal plate in which plural communication holes through which the pressure chambers 10 communicate with the corresponding nozzles 8 are formed. The nozzle plate 30 is a metal plate in which the plural nozzles 8 are formed. These nine metal plates are positioned and stacked together so as to form the individual ink flow paths 32.

Figure 5A:
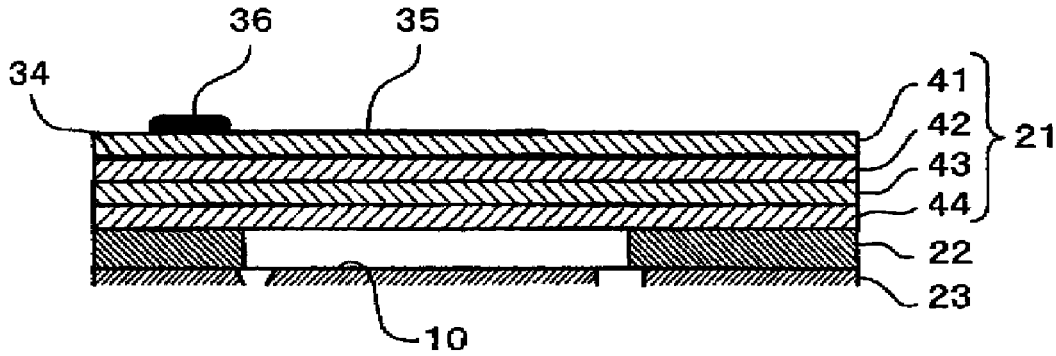
FIG. 5A is an enlarged view showing the vicinity of an piezoelectric actuator of FIG. 4.

As shown in FIG. 5A, the piezoelectric actuator 21 has a stacked structure in which four piezoelectric layers 41, 42, 43, 44 are stacked together. Each of the piezoelectric layers 41 to 44 has a thickness of about 15 μm, and the thickness of the piezoelectric actuator 21 is about 60 μm. The piezoelectric layers 41 to 44 are laminated flat plates (flat layers) that are placed over the many pressure chambers 10 formed in one ink ejection region of the head body 13. The piezoelectric layers 41 to 44 are made of lead zirconate titanate (PZT) base ceramic material exhibiting ferroelectricity.

Figure 5B:
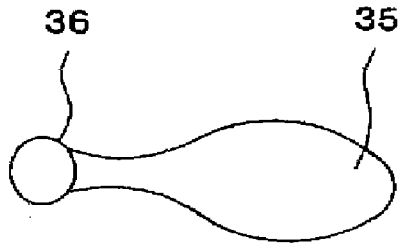
FIG. 5B is an enlarged plan view showing an individual electrode of FIG. 5A.

As shown in FIG. 5A, the individual electrode 35 having a thickness of about 1 μm is formed on the uppermost piezoelectric layer 41. The individual electrode 35 and a common electrode 34 which will be described later are made of a metal material such as Ag—Pd base material. As shown in FIG. 5B, the individual electrode 35 has a substantially rhombic plan shape and is formed so that the electrode is opposed to the pressure chamber 10 and a major portion of the electrode in a plan view is disposed within the pressure chamber 10. As shown in FIG. 3, therefore, the plural individual electrodes 35 are regularly arranged in a two-dimensional manner over a substantially whole area of the uppermost piezoelectric layer 41. In this aspect, the individual electrodes 35 are formed only on the surface of the piezoelectric actuator 21, and hence only the piezoelectric layer 41 which is the outermost layer of the piezoelectric actuator 21 includes an active region in which electrostriction is caused by external electric voltage. Therefore, the piezoelectric actuator 21 is an actuator which produces unimorph deformation, and the deformation efficiency is high.

One of acute-angle portions of the individual electrode 35 extends to a beam portion 22*a* (portion of the cavity plate 22 where the pressure chamber 10 is not formed) of the cavity plate 22 bonded to the piezoelectric actuator 21 to support the cavity plate 22. A land 36 having a thickness of about 15 μm is formed in the vicinity of the tip end of the extending portion. The individual electrode 35 and the land 36 are electrically connected to each other. The land 36 is formed, for example, of gold containing glass frit. The land 36 is a member through which the individual electrode 35 is electrically connected to a contact formed on the FPC.

Between the uppermost piezoelectric layer 41 and, the piezoelectric layer 42 thereunder, the common electrode 34 having a thickness of about 2 μm and formed over the whole face of the layers is interposed. In the portion opposed to the pressure chamber 10, the piezoelectric layer 41 is sandwiched between, the individual electrode 35 and the common electrode 34. No electrode is interposed between the piezoelectric layers 42 and 43.

The common electrode 34 is grounded in a region (not shown). Therefore, the common electrode 34 is equally kept at the ground potential 0 V (V2) in regions corresponding to all the pressure chambers 10. The many individual electrodes 35 are individually electrically connected through contacts and wirings on the FPC to a driver IC (not shown) that is a part of the controller 100, in order to allow the potentials of the individual electrodes to be individually controlled. In this aspect, a surface electrode is formed on the piezoelectric layer 41 around electrode groups formed by the individual electrodes 35. The surface electrode is electrically connected to the common electrode through a through hole and also to another contact and wiring on the FPC in the same manner as the plural individual electrodes 35.

Hereinafter, the operation of the piezoelectric actuator 21 will be described. In the piezoelectric actuator 21, only the piezoelectric layer 41 is polarized in the direction from the individual electrode 35 toward the common electrode 34. A predetermined voltage, for example, 20 V (V1) is previously applied to the individual electrode 35 by the driver IC. Therefore, a potential difference is produced between the individual electrode 35 and the common electrode 34 at the ground potential, and, in a region (active region) of the piezoelectric layer 41 sandwiched between the individual electrode 35 and the common electrode 34, an electric field is generated in the thickness direction. As a result, the active region of the piezoelectric layer 41 is contracted by the piezoelectric transverse effect in a direction perpendicular to the polarization direction. An electric field is not applied to the other piezoelectric layers 42 to 44, and therefore they are not contracted spontaneously. In the portions of the piezoelectric layers 41 to 44 opposed to the active region, therefore, unimorph deformation that is convex toward the pressure chamber 10 is produced as a whole. At this time (first state), the volume of the pressure chamber 10 is smaller than that in the case where the predetermined voltage is not applied to the individual electrode 35.

Figure 6:
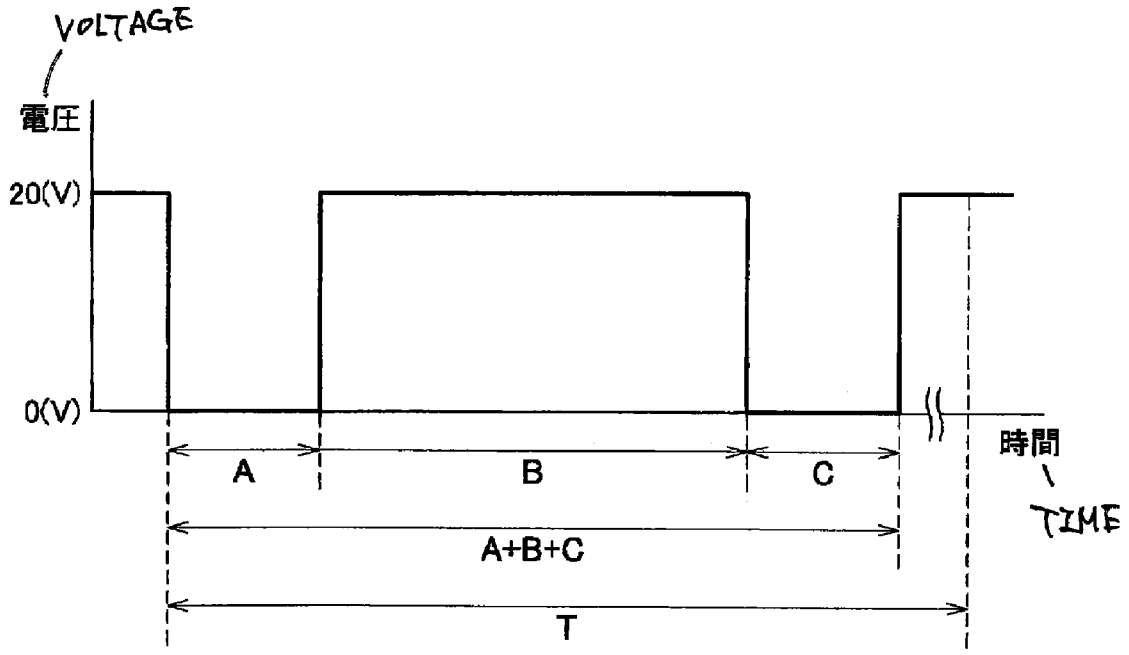
FIG. 6 is a view showing drive voltage pulse signals applied to the individual electrode.

Upon an ejection request, at first, the individual electrode 35 is set at the ground potential from the state in which the predetermined voltage is applied to the individual electrode 35. Then, the piezoelectric sheets 41 to 44 return to their original states, whereby the volume of the pressure chamber 10 is increased (second state) as compared with the first state, and the ink is sucked into the pressure chamber 10 from the submanifold flow path 5*a*. After elapse of a time period A (μs), the predetermined potential is again applied to the individual electrode 35. Then, the portions of the piezoelectric layers 41 to 44 opposed to the active region are deformed so as to be convex toward the pressure chamber 10 (returns to the first state), the pressure of the ink is raised by the volume change in the pressure chamber 10, and the ink is ejected from the nozzle 8. After elapse of a time period B (μs), then, the individual electrode 35 is set at the ground potential, and the volume of the pressure chamber 10 is increased (set to the second state), and, after elapse of a time period C (μs), the predetermined potential is again applied to the individual electrode 35. In the same manner as described above, then, the pressure chamber returns to the first state, and the ink is ejected from the nozzle 8. As shown in FIG. 6, during a printing period T which is a time period required for the printing sheet P to be moved along the transport path by a unit distance corresponding to the resolution of the printing, a series of operations in which drive voltage pulse signals having pulse widths A and C are applied at a pulse interval B to the individual electrode 35. Thus, an operation to once set the individual electrode 35 at the ground potential and then return the individual electrode 35 at the predetermined potential is repeated two times so that two ink droplets are successively ejected from the nozzle 8 during the printing period T.

The time period A indicates the time period from the time when a first transition from the first state to the second state is started, to the time when a first return from the second state to the first state is started. The time period B indicates the time period from the time when the first return from the second state to the first state is started, to the time when the second transition from the first state to the second state is started. The time period C indicates the time period from the time when a second transition from the first state to the second state is started, to the time when a second return from the second state to the first state is started. The time periods A, B, C are set so as to satisfy all of relationships including $4.5AL \leqq A+B+C \leqq 5.4AL$, $2.60AL \leqq B \leqq 3.35AL$, and $0.92AL \leqq C \leqq 1.03AL$. The time period AL (μs) indicates a time period form the time when the transition from the first state to the second state starts, to the time when the return form the second state to the first state starts, causing the ejection speed of ink droplets ejected from the nozzle 8 to be maximum. That is, the time period AL is the time period required for a pressure wave generated at a change of the volume of the pressure chamber 10 to be reflected and then return to the pressure chamber 10.

Figure 7A:
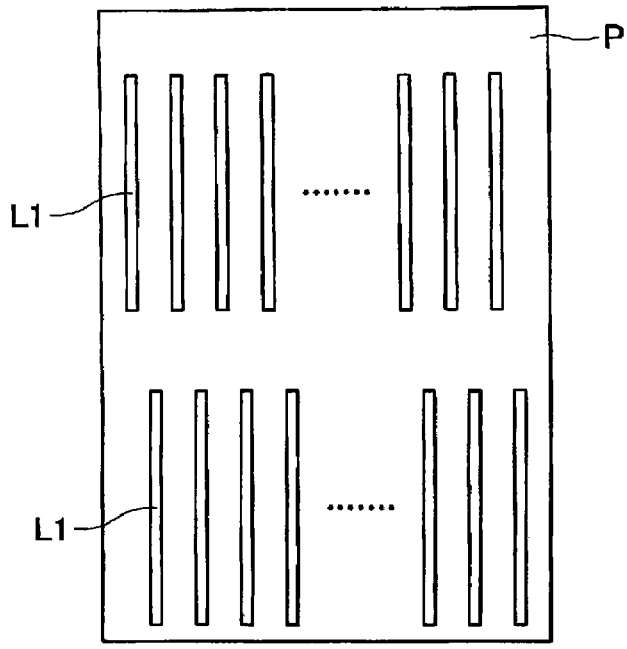
FIGS. 7A and 7B are views showing a method of determining whether printing is normally performed or not.
Figure 7B:
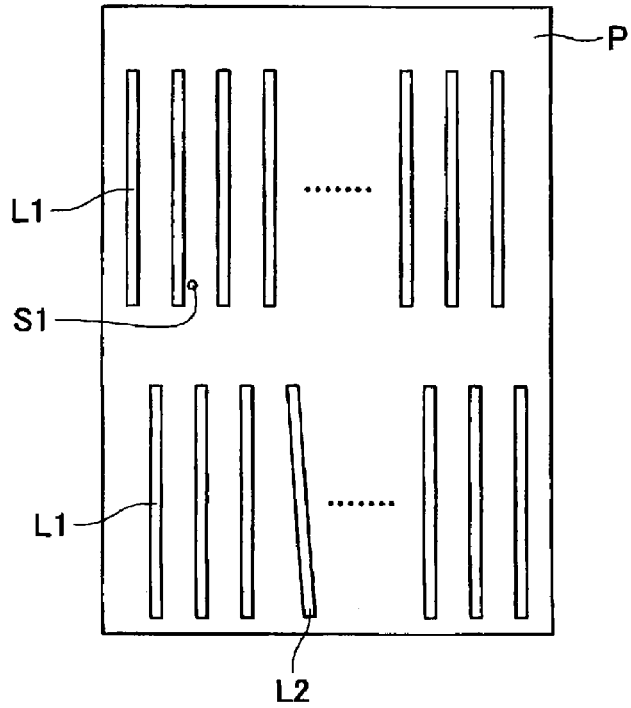

Now, the timing when the individual electrode 35 is set at the ground potential upon an ejection request, and the timing when the predetermined potential is again applied to the individual electrode 35, i.e., the time periods A, B, C will be described. The time periods A, B, C are set so that the ejection characteristics of ink droplets ejected from plural nozzles 8 are not dispersed. In order to determine the time periods A, B, C, as shown in FIG. 7A, the ink is ejected from a half of or every other ones of the plural nozzles 8 arranged with 600 dpi, in the method described above to print plural straight lines L1 that extends in parallel to the direction along the transport path of the printing sheet P, in the upper half of the printing sheet P, and the ink is then ejected from the remaining half of the plural nozzles 8 to form plural similar straight lines L1 in the lower half of the printing sheet P. It is determined whether, as shown in FIG. 7B, an ink droplet S1 reaching a position deviated from the straight lines L1, or a straight line L2 printed with deviation from the direction parallel to the direction along the transport path of the printing sheet P exists or not. Depending on the existence of the ink droplet S1 and the line L2, deviation angles of the reaching position of the ink droplet S1 and the straight line L2 with respect to the direction along the transport path of the printing sheet P, it is determined for the plural nozzles 8 whether the dispersion of ejection characteristics of ink droplets is large or not. In this way, printings are performed by the plural nozzles 8 at different two timings in different places, because sufficient gaps are formed between adjacent straight lines L1 to allow the dispersion of ejection characteristics of ink droplets to be easily determined.

While changing the time period A in the range of AL±1 (μs), the time period B in the range of 0.324AL to 3.351AL (μs), and the time period C in the range of 0.108AL to 1.243AL (μs), printings and determinations are performed in the manner as described above. In this aspect, as shown in FIG. 4, each of the nozzles 8 is configured by a tapered portion 8*a* and a straight portion 8*b* that is continuous thereto. The aperture diameter (nozzle diameter) of the straight portion 8*b* is 20 to 25 μm.

Figure 8:
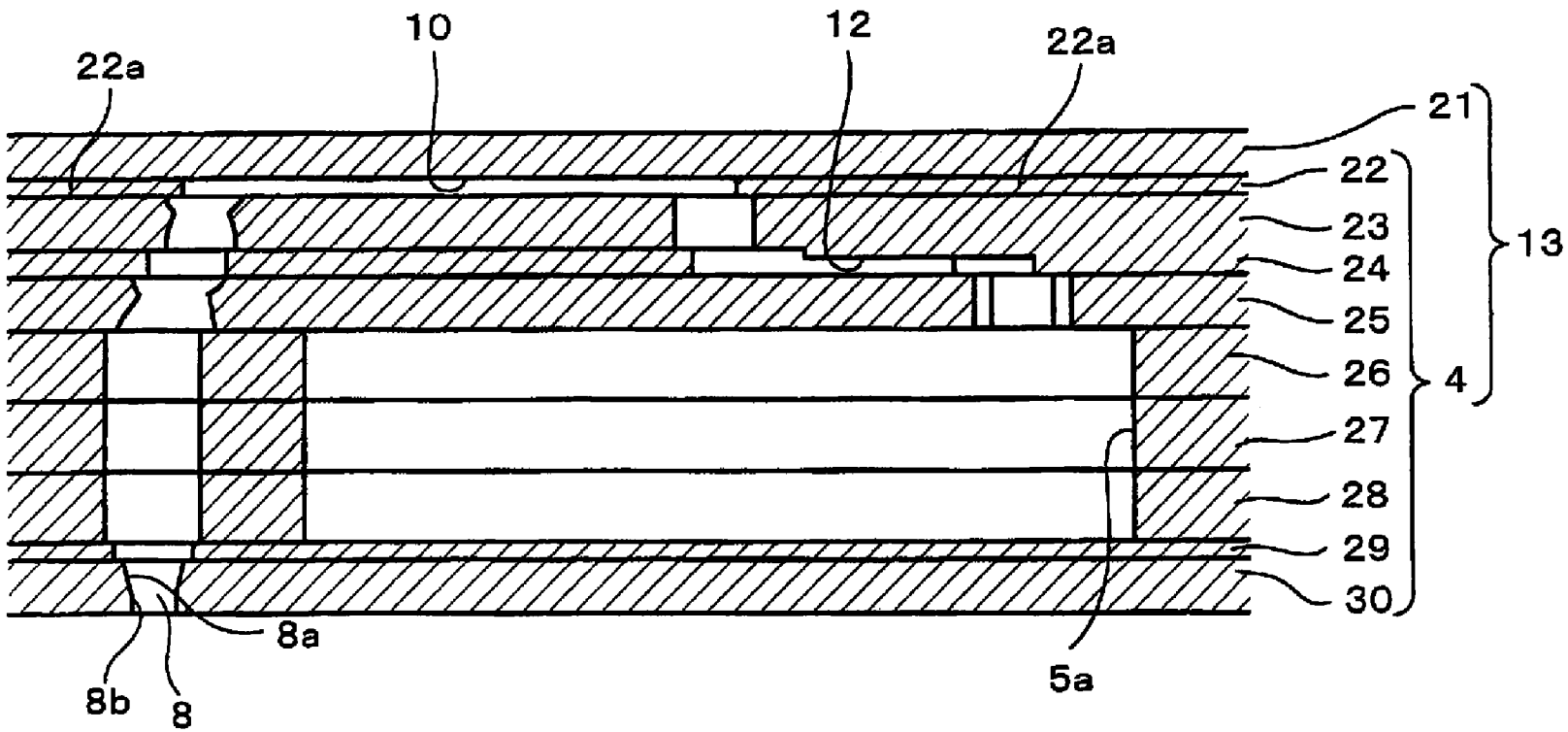
FIG. 8 is a table showing results which were obtained by the method shown in FIGS. 7A and 7B.

FIG. 8 shows a table of an example of results of such printings and determinations. In the table of FIG. 8, at each cell representing the intersection of a row of time period B and a column of time period C, a value indicating (A+B+C) is shown. The values of the table show multiples of the time periods B, C, and (A+B+C) with respect to AL, respectively. Values in the case where any one of the ink droplet S1 and the straight line L2 was not printed are underlined. From the results, it was determined that, when all of $4.5AL \leqq A+B+C \leqq 5.4AL$, $2.60AL \leqq B \leqq 3.35AL$, and $0.81AL \leqq C \leqq 1.14AL$ are satisfied (the range enclosed by the double line in FIG. 8), dispersion of the ejection characteristics of ink droplets ejected from the plural nozzles 8 is reduced. In this range, non-underlined values in FIG. 8 are included, in which the ink droplet S1 or the straight line L2 existed, but it was determined that dispersion of the ejection characteristics of ink droplets ejected from the plural nozzles 8 was small. This determination was made based on the observation that the ink droplet S1 impinges at a position which is relatively close to the straight line L1 and the deviation angle of the line L2 with respect to the direction along the transport path of the printing sheet P is relatively small.

In the range, when $0.92AL \leqq C \leqq 1.03AL$ is satisfied (the range enclosed by the thick line in FIG. 8), any one of the ink droplet S1 and the straight line L2 was not printed, and it was determined that dispersion of the ejection characteristics of ink droplets ejected from the plural nozzles 8 was particularly small.

According to the above-described aspect, in the inkjet head 2 in which, upon an ejection request, two ink droplets are successively ejected from one nozzle 8, the time periods A, B, C of the drive voltage pulse signals shown in FIG. 6 are set so as to satisfy all of $4.5AL \leqq A+B+C \leqq 5.4AL$, 2.60AL ≦B≦3.35AL, and 0.81AL≦C≦1.14AL. Even when the plural individual ink flow paths 32 are dispersed, dispersion of the ejection characteristics of ink droplets ejected from the plural nozzles 8 is reduced.

In the above, the time period C is set so that the relationship: 0.92AL≦C≦1.03AL is satisfied. Therefore, dispersion of the ejection characteristics of ink droplets ejected from the plural nozzles 8 is surely reduced.

Since the plural pressure chambers 10 are arranged in a matrix pattern in two directions intersecting with each other, dispersion of the ejection characteristics of ink droplets ejected from the plural nozzles 8 is surely reduced.

Since the piezoelectric actuator 21 includes: the piezoelectric layer 41; and the plural pairs of electrodes (the individual electrode 35 and the common electrode 34), which sandwiches the piezoelectric layer at positions opposed to the pressure chambers 10, dispersion of the ejection characteristics of ink droplets ejected from the plural nozzles 8 is surely reduced.

In two ink droplets which are ejected from the plural nozzles 8 as described above, dispersion of the ejection characteristics is small. Since printing is performed while one nozzle 8 ejects only two ink droplets during the printing period, dispersion of the ejection characteristics of ink droplets ejected from the plural nozzles 8 is surely reduced.

In the above-described aspect, one nozzle 8 ejects two ink droplets during the printing period. Alternatively, three or more droplets may be ejected. In the alternative, when ink ejection for the initial two ink droplets is performed at the same timings as those in the above-described aspect, the ejection characteristics are not dispersed. When timing of ejecting the third and subsequent ink droplets are adequately adjusted, therefore, it is possible to reduce dispersion of the ejection characteristics of ink droplets ejected from the plural nozzles 8.

FIG. 9 shows a table of the above-described example of results of the printings and determinations in a different format from that of FIG. 8. In the table of FIG. 9, at each cell representing the intersection of a row of time ratio B/A and a column of time ratio C/A, a value indicating (A+B+C) is shown. The values of each cell shows multiples of the time periods (A+B+C) with respect to AL. Values in the case where any one of the ink droplet S1 and the straight line L2 was not printed are underlined same as FIG. 8. From the results, it was determined that, when 2.60 ≦B/A≦3.35 , and 0.81 ≦C/A≦1.14 are satisfied (the range enclosed by the double line in FIG. 9), dispersion of the ejection characteristics of ink droplets ejected from the plural nozzles 8 is reduced. In this range, non-underlined values in FIG. 9 are included, but it was determined that dispersion of the ejection characteristics of ink droplets ejected from the plural nozzles 8 was small by the above described manner.

In the above, the sum of time periods A, B and C is set so that the relationship: 4.5AL≦A+B+C≦5.4AL is satisfied.

According to the above-described aspect, in the inkjet head 2 in which, upon an ejection request, two ink droplets are successively ejected from one nozzle 8, the time periods A, B, C of the drive voltage pulse signals shown in FIG. 6 are set so as to satisfy 2.60≦B/A≦3.35, and 0.81 ≦C/A≦1.14.

Even when the plural individual ink flow paths 32 are dispersed, dispersion of the ejection characteristics of ink droplets ejected from the plural nozzles 8 is reduced.

What is claimed is:

1. An inkjet printer comprising:

an inkjet head that moves relative to a recording medium to perform printing, the inkjet head including, a flow path unit including a plurality of pressure chambers respectively communicating with a plurality of ink ejection ports that ejects ink droplets toward the recording medium, and a piezoelectric actuator configured to take a first state where a volume of the pressure chamber is to be V1, and a second state where the volume of the pressure chamber is to be V2 larger than V1; and a controller that supplies a drive pulse signal to the piezoelectric actuator in order to repeat an operation in which the piezoelectric actuator transits from the first state to the second state and returns to the first state, during a printing period required for the recording medium and the inkjet head to relatively move by a unit distance corresponding to a resolution of the printing, for enabling the corresponding ink ejection port to eject a plurality of ink droplets at an ejecting speed, wherein the controller supplies the drive pulse signal so that the following relationships are satisfied, $$4.5AL \leqq A+B+C \leqq 5.4AL,$$

$$2.60AL \leqq B \leqq 3.35AL, \text{ and}$$

$$0.81AL \leqq C \leqq 1.14AL,$$

where

AL represents a time period from a time when a transition from the first state to the second state is started, to a time when a return from the second state to the first state is started, causing the ejecting speed to be maximum, A represents a time period from a time when a first transition from the first state to the second state is started, to a time when a first return from the second state to the first state is started, during the printing period, B represents a time period from the time when the first return from the second state to the first state is started, to a time when a second transition from the first state to the second state is started, during the printing period, C represents a time period from the time when the second transition from the first state to the second state is started, to a time when a second return from the second state to the first state is started, during the printing period.

2. The inkjet printer according to claim 1, wherein the following relationship is satisfied, 0.92AL≦C≦1.03AL.

3. The inkjet printer according to claim 1, wherein the pressure chambers are arranged in a matrix pattern in two directions intersecting with each other in the flow path unit.

4. The inkjet printer according to claim 1, wherein the piezoelectric actuator includes:

a piezoelectric layer; and a plurality of electrodes placed corresponding to the pressure chambers and sandwiching the piezoelectric layer.

5. The inkjet printer according to claim 1, wherein the controller supplies the drive pulse signal to the piezoelectric actuator in order to repeat the operation only two times during the printing period.

6. An inkjet printer comprising:

an inkjet head that moves relative to a recording medium to perform printing, the inkjet head including, a flow path unit including a plurality of pressure chambers respectively communicating with a plurality of ink ejection ports that ejects ink droplets toward the recording medium, and a piezoelectric actuator configured to take a first state where a volume of the pressure chamber is to be V1, and a second state where the volume of the pressure chamber is to be V2 larger than V1; and a controller that supplies a drive pulse signal to the piezoelectric actuator in order to repeat an operation in which the piezoelectric actuator transits from the first state to the second state and returns to the first state, during a printing period required for the recording medium and the inkjet head to relatively move by a unit distance corresponding to a resolution of the printing, for enabling the corresponding ink ejection port to eject a plurality of ink droplets at an ejecting speed, wherein the controller supplies the drive pulse signal so that the following relationships are satisfied, $$2.6 \leqq B/A \leqq 3.35, \text{ and}$$

$$0.81 \leqq C/A \leqq 1.14,$$

where

A represents a time period from a time when a first transition from the first state to the second state is started, to a time when a first return from the second state to the first state is started, during the printing period, B represents a time period from the time when the first return from the second state to the first state is started, to a time when a second transition from the first state to the second state is started, during the printing period, C represents a time period from the time when the second transition from the first state to the second state is started, to a time when a second return from the second state to the first state is started, during the printing period.

7. The inkjet printer according to claim 6, wherein the following relationship is satisfied, $$4.5AL \leqq A+B+C \leqq 5.4AL,$$

where AL represents a time period from a time when a transition from the first state to the second state is started, to a time when a return from the second state to the first state is started, causing the ejecting speed to be maximum.

8. The inkjet printer according to claim 6, wherein the controller supplies the drive pulse signal to the piezoelectric actuator in order to repeat the operation only two times during the printing period.

* * * * *